US005836394A

United States Patent [19]

Blank

[11] Patent Number: 5,836,394

[45] Date of Patent: Nov. 17, 1998

[54] WELL REGENERATION APPARATUS

[76] Inventor: Karl-Heinz Blank, Mühlenstr. 2A, D-50259 Pulheim, Germany

[21] Appl. No.: 887,619

[22] Filed: Jul. 3, 1997

[30] Foreign Application Priority Data

Jul. 7, 1996 [WO] WIPO ..... PCT/DE96/01215
Feb. 28, 1997 [DE] Germany ..... 197 08 140.1

[51] Int. Cl.[6] ..... E21B 37/08

[52] U.S. Cl. ..... 166/312; 166/334.2; 166/334.4; 166/223; 166/117.2

[58] Field of Search ..... 166/311, 312, 166/319, 334.2, 334.4, 223, 117.2, 249

[56] References Cited

U.S. PATENT DOCUMENTS

| | | | |
|---|---|---|---|
| 4,037,661 | 7/1977 | Ford | 166/311 |
| 4,372,384 | 2/1983 | Kinney | 166/319 X |
| 4,892,145 | 1/1990 | Stafford . | |
| 5,318,128 | 6/1994 | Johnson et al. | 166/312 |

FOREIGN PATENT DOCUMENTS 0620356 10/1994 European Pat. Off. .
4037899 6/1992 Germany .

*Primary Examiner*—Roger J. Schoeppel
*Attorney, Agent, or Firm*—Robert W. Becker & Associates

[57] ABSTRACT

A well regeneration apparatus and method of accomplishing same are provided. A scrubber pump is associated with a device for mechanically cleaning a well casing for washing and scrubbing a filter pipe portion of the well casing, and a gravel bed that surrounds the well casing, by means of a fluid. A feed pump is disposed above the scrubber pump, and the pressure side of the feed pump is connected to a riser that leads out of the well. A pump chamber of the scrubber pump communicates with the suction side of the feed pump. A further chamber is disposed in the vicinity of the scrubber pump and serves to accommodate the mechanically cleaning device. The pump chamber of the scrubber pump is disposed above the further chamber and serves to accommodate components of the scrubber pump that convey fluid outwardly into the gravel bed, in particular such that fluid passes out of the gravel bed, via the lower further chamber into the upper chamber of the scrubber pump, and from the upper chamber into the gravel bed.

16 Claims, 2 Drawing Sheets

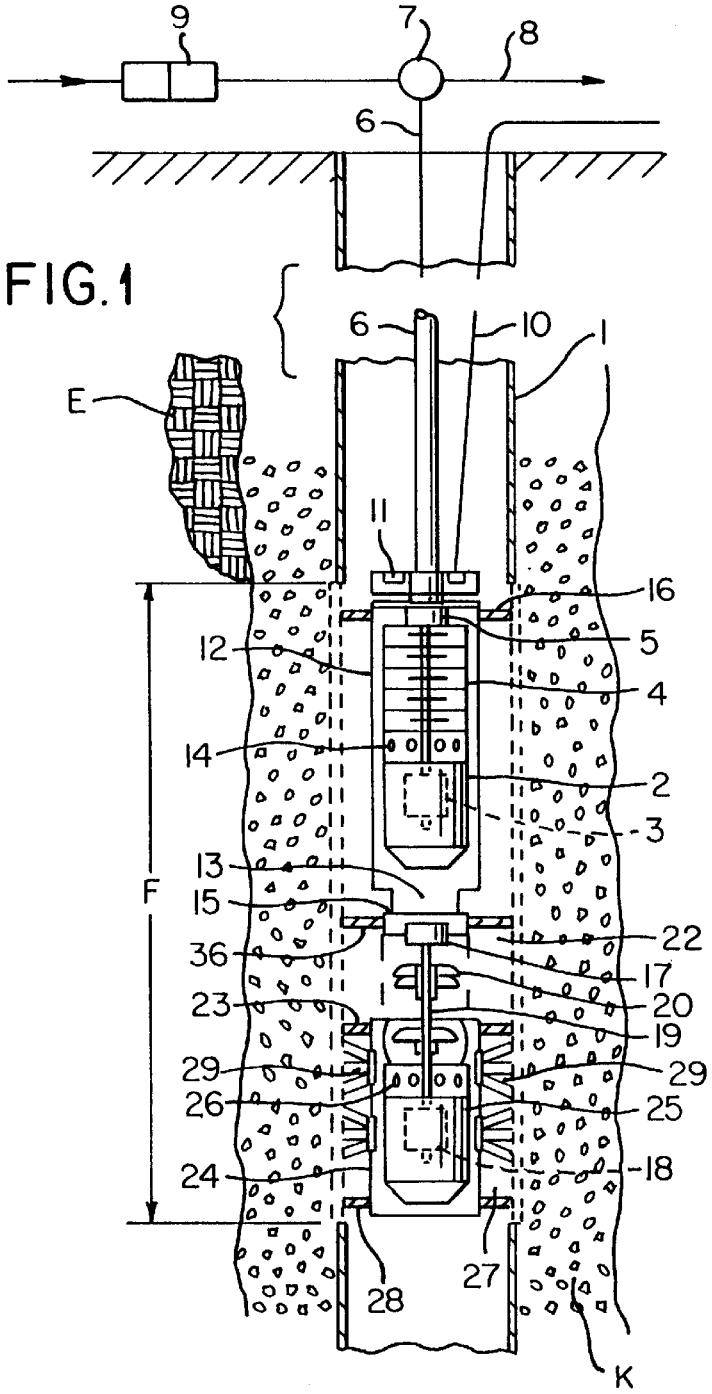
FIG.1
FIG.6
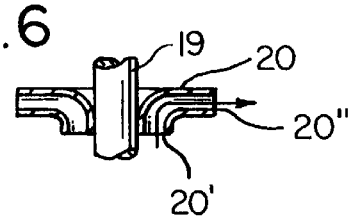

WELL REGENERATION APPARATUS

BACKGROUND OF THE INVENTION

The present invention relates to a well regeneration apparatus including a means for mechanically cleaning the well casing. In addition, the present invention relates to a method of regenerating wells.

With apparatus of this type it is known to dispose within the filter pipe brushes that can be raised and lowered in order in a mechanical manner to clean the filter pipe, especially its generally slot-shaped perforation, for example to remove crust formations found there or other foreign bodies. It is furthermore known to utilize liquid cleaning agents and to force the same under pressure from the interior of the well casing outwardly into the gravel bed found there.

These measures and apparatus are utilized one after the other, for example a rinsing and washing following the mechanical cleaning of the well casing, in other words, after the brushes have been removed from the well casing, in order then to be able to lower a pump with which the rinsing and washing can be carried out.

It is an object of the present invention to simplify and accelerate well regeneration and to make the successive operating steps of extraction and lowering of tools and pumps unnecessary.

BRIEF DESCRIPTION OF THE DRAWINGS

This objects, and other objects and advantages of the present invention will appear more clearly from the specification in conjunction with the accompanying schematic drawings, in which:

FIGS. 1–5 are respective vertical, cross-sectional views through one exemplary embodiment of the inventive well regeneration apparatus in a lowered state and various operating conditions; and FIG. 6 is a radial cross-sectional view through a pump rotor for a scrubber pump.

SUMMARY OF THE INVENTION

Figure 2:
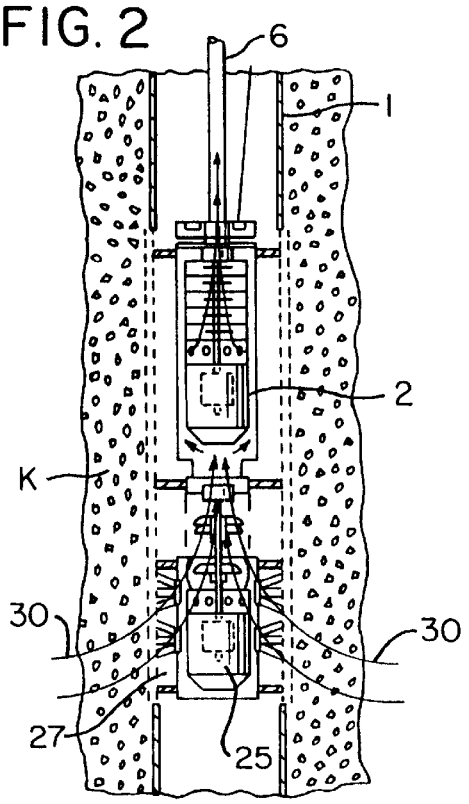

To realize the object of the present invention it is proposed to associate with the device for mechanically cleaning the well casing a pump, hereinafter called a washer or scrubber pump, for washing and scrubbing the gravel bed that surrounds the well casing and/or the filter pipe by means of a fluid (water); in addition, the pump chamber of this pump (scrubber pump) is connected to the suction side of a further feed pump that is disposed above the scrubber pump and to the pressure side of which is connected a riser that leads to the well inlet, in other words, leads out of the well. The riser preferably serves not only for withdrawing fluid from the well but also for conveying fluid into the well, with such introduction of fluid into the well being effected in particular through the feed pump, in a non-operative state thereof, counter to the normal direction of feed thereof.

An apparatus embodied in such a way, the components of which are interconnected in such a way that the apparatus can be raised and lowered as a complete unit, makes it possible to accomplish successive, important functions and operations in the region of the filter pipe without for this purpose having to remove the apparatus or components thereof from the well and having to replace them with other devices. The following operations are possible with the inventive regeneration apparatus:

a. When the mechanical cleaning of the filter pipe is accomplished, for example by raising and lowering movements, an internal cleaning of the filter pipe can be accomplished by drawing off the generally very dirty water with the feed pump.

b. After or even during the mechanical cleaning, the cleaning of the filter slots, a loosening of the gravel bed, and possibly also a cleaning of the gravel bed can be effected by pump pressure from the scrubber pump that is associated with the mechanical cleaning means and that presses the liquid from within via the slots into the gravel bed and in a reverse order draws water out of the gravel ballast, which can occur in a sort of circulation.

c. After the treatment indicated in b. above, the feed pump can draw off water and convey it outwardly via the riser.

d. With the feed pump not in operation, water that possibly contains additives can be introduced into the gravel bed from above via the riser and the feed pump.

With a view toward the operational efficiency of the inventive apparatus, this apparatus concerns a combination apparatus which, as mentioned previously, can be raised and lowered as a unit, and in particular preferably via the aforementioned riser, which is of course to be made appropriately inextensible. In so doing it is to be understood that the apparatus is provided with suitable control and supply lines. The mechanical treatment of the well casing in the manner previously mentioned can be effected by brushes, although it is also possible to provide an ultrasonic treatment.

It is furthermore expedient to provide the apparatus with three transverse disks having seals on their outer periphery that are dimentioned in conformity with the inner diameter of the well casing in order in this way when the apparatus is being operated to form chambers between two disks, in which case the disks then form partitions. This chamber formation is advantageous for that part of the apparatus that forms the mechanical cleaning. In this connection, the brushes or ultrasonic sensors are disposed in one chamber, whereas disposed in a chamber located thereabove, preferably in a directly adjoining chamber, are rotors that are embodied in the manner of centrifugal pump rotors or armatures and that during the washing or rinsing process drive water from the interior of the filter pipe through the slots into the gravel bed.

In this connection, the feed pump can adjoin the upper chamber wall. However, a pipe-like casing must ensure that the water coming from the upper chamber is conveyed to the suction connection of the feed pump. An additional centering of the feed pump at the upper end within the well casing is also expedient.

It is to be understood that all rotating elements of the apparatus are concentrically disposed in the apparatus and also later within the well casing.

Further specific features of the present invention will be described in detail subsequently.

DESCRIPTION OF PREFERRED EMBODIMENTS

Referring now to the drawings in detail, the inventive apparatus is introduced into the well casing 1 of the water well. In the region F, the well casing 1 is embodied as a filter pipe, where it is provided with perforations, preferably in the form of fine slots. The well casing is surrounded by a gravel bed or ballast K, which in turn is surrounded by the ground or soil E.

The upper part of the apparatus is essentially formed by a feed pump 2 with an electric motor 3, a multi-stage rotor feed portion 4, and a discharge 5 to which is connected a riser 6. The upper portion of the riser 6 is guided out of the well, where by means of the valve 7 it is either switched to discharge in the direction of the arrow 8, or can be connected to the pressure side of a pump 9. The riser 6 at the same time serves for suspending the apparatus in the well water. A supply and control line 10 leads to a switch box 11. The feed pump 2 is furthermore concentrically installed in a casing 12 that is concentrically disposed relative to the well casing 1. The upper portion of the casing 12 is closed off, while the bottom of the casing is provided with an opening 13 by means of which a communication with the suction connection 14 of the feed pump 2 is established.

The bottom of the casing 12 is secured to a mounting means 15 that is fixedly connected with the lower portion of the apparatus. In addition, the outer periphery of the upper end of the feed pump 2 and of the casing 12 are centered within the well casing 1 by means of a circular plate or disk 16 that is possibly provided with an elastomeric sealing means.

Disposed in the center of a further disk 36 are a seating for the mounting means 15 and a support 17 for the free end of a shaft 19 that is driven by an electric motor 18; mounted on the shaft 19 are one or more pump rotors 20, as shown in greater detail in FIG. 6. The disk 36 in addition delimits the upper portion of a chamber 22. The outer periphery of the disk 36 is provided with a sealing ring for sealing purposes.

The bottom part of the chamber 22 is delimited by a transverse disk 23 that is embodied in conformity to the disk 36. The transverse disk 23 is carried by a perforated pipe 24 that is closed off at the bottom and in which is disposed with play the washer or scrubber pump 25 with the pump rotors 20 and the suction connection 26; the scrubber pump 25 is driven by the electric motor 18. On its inner periphery, the pipe 24 delimits a further chamber 27 that at the bottom is similarly delimited by a transverse disk 28 and essentially serves for accommodating brushes 29 that are distributed over the periphery of the pipe 24.

The pump rotor 20 is embodied in the manner of a rotor or armature of a centrifugal pump. Accordingly, in the vicinity of the shaft 19 the pump rotor 20 is provided with the inlet 20' and at the outer periphery in view of the centrifugal forces is provided with the outlet 20". Therefore, when the scrubber pump 25 is turned on, the water located in the chamber 22 is driven outwardly from the center of the chamber 22 through the perforations of the filter pipe.

Since on the one hand the apparatus can be raised and lowered in its entirety in the region F, and on the other hand the feed pump 2 and the scrubber pump 25 can each be individually turned on and off, a large number of possibilities for well regeneration result. However, after introducing the apparatus into the region F, the operation is preferably as follows:

With the scrubber pump 25 turned off and the feed pump 2 turned on (with an appropriate setting of the valve 7), a mechanical well cleaning is carried out by raising and lowering the apparatus, i.e. the brushes 29, and during this process water is withdrawn from the gravel bed K in the direction of the arrows 30 and is withdrawn via the chamber 27 (see FIG. 2). The dirty water is drawn off upwardly.

To loosen the gravel bed, as well as to loosen and clean the deposits at that location and furthermore to clean the slots of the filter, a washing or scrubbing is carried out. For this purpose, the scrubber pump 25 is turned on. Water is drawn-in in the direction of the arrows 31 (see FIG. 3) via the slots of the region F and the perforations of the pipe 24. This water is then returned, or driven out, in the directions of the arrows 32 by the rotors 20 out of the upper chamber 22 and again via the slots of the filter pipe into the gravel bed K.

Figure 4:
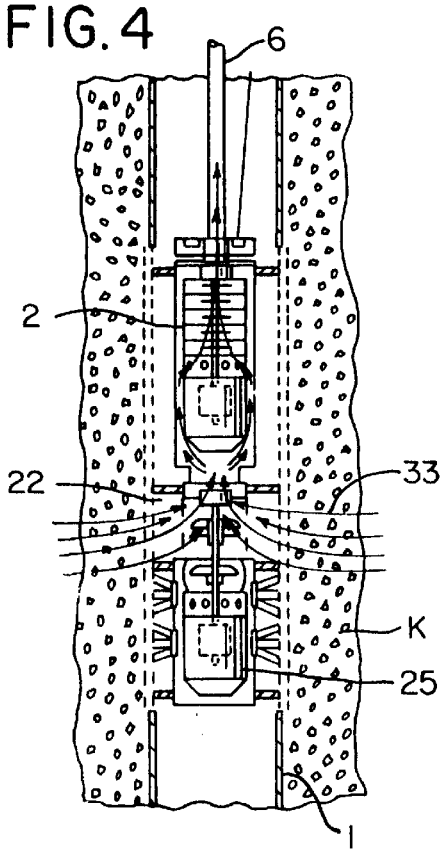

With the scrubber pump turned off, the feed pump 2 is now turned on and the water which is permeated with loosened deposits and fine sands, is pumped off in the direction of the arrows 33, and in particular predominantly via the chamber 22 (see also FIG. 4).

The previously mentioned scrubbing process and the last mentioned pumping-off are processes that are successively repeated a number of times, and in particular with cycle times of approximately 4 to 8 minutes for each operation.

Figure 5:
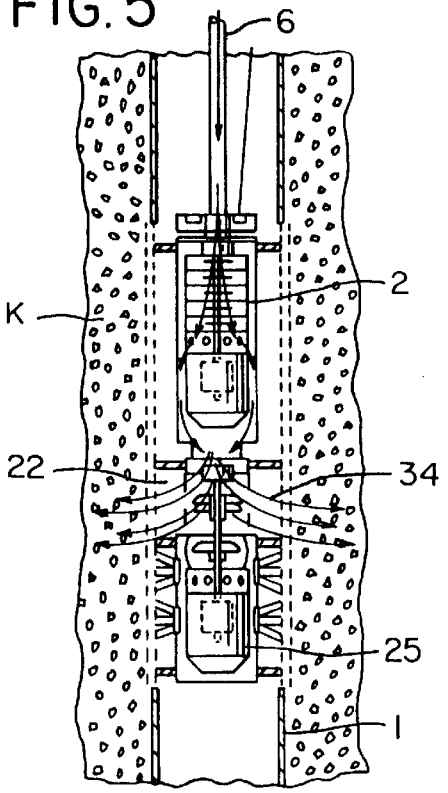

After the regeneration has thus been undertaken so to speak on site, there is effected in the last step pursuant to FIG. 5, with appropriate setting of the valve 7 and with the pump 9 turned on and the pumps 2 and 25 turned off, the introduction of water with desired additives in the direction of the arrows 34 via the slots of the filter tube in the region F into the gravel bed K, and in particular preferably via the chamber 22.

It should be noted that the term regeneration used here encompasses all operations that are required in order to be able to again clean and prepare a water well that has been operating for a long period of time such that it can again return to its original performance in an economical manner. Thus, included are not only the mechanical operation, but rather also the possibly provided chemical action and furthermore also the maintenance of water wells.

Figure 3:
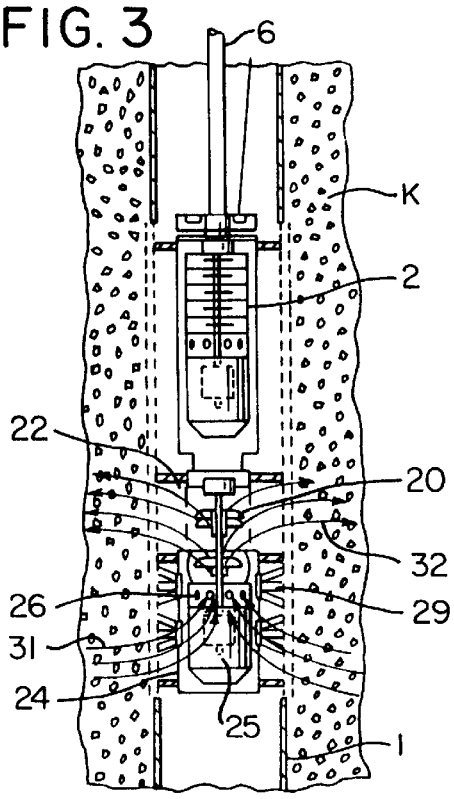

It should also be noted that it would be conceivable to eliminate the bottom disk 28 if the flow paths of FIG. 3 are ensured. However, delimiting the chamber 22 at the top and at the bottom as illustrated is important in order to ensure the action of water on the filter tube from within via the pump rotors 20.

The present invention is, of course, in no way restricted to the specific disclosure of the specification and drawings, but also encompasses any modifications within the scope of the appended claims.

I claim:

1. A well regeneration apparatus, including means for mechanically cleaning a well casing, comprising:

a scrubber pump associated with said means for mechanically cleaning a well casing for washing and scrubbing a filter pipe portion of said well casing, and a gravel bed that surrounds said well casing, by means of a fluid;

a feed pump adapted to be disposed above said scrubber pump, wherein a pressure side of said feed pump is connected to a riser that leads out of said well, and wherein a pump chamber of said scrubber pump communicates with a suction side of said feed pump; and a further chamber disposed in the vicinity of said scrubber pump and serving to accommodate said means for mechanically cleaning a well casing, wherein said pump chamber of said scrubber pump is disposed above said further chamber and serves to accommodate components of said scrubber pump that convey fluid outwardly into said gravel bed, in particular such that fluid passes out of said gravel bed, via said lower further chamber into said upper pump chamber, and from the latter into said gravel bed.

2. A well regeneration apparatus according to claim 1, wherein means are provided such that said riser serves not only for the withdrawal of fluid out of said well but also for the supply of fluid into said well, with said feed pump turned off, through said feed pump counter to a feed direction thereof.

3. A well regeneration apparatus according to claim 1, wherein the components that form said apparatus are fixedly connected to one another and are adapted to be raised and lowered in common in well water.

4. A well regeneration apparatus according to claim 1, wherein a perforated pipe is provided that surrounds components of said scrubber pump, wherein said means for mechanically cleaning a well casing are brushes that are distributed over the periphery of said perforated pipe.

5. A well regeneration apparatus according to claim 1, wherein said means for mechanically cleaning a well casing are ultrasonic means.

6. A well regeneration apparatus according to claim 1, wherein transversely extending disks are provided for delimiting said pump chamber and said further chamber.

7. A well regeneration apparatus according to claim 6, wherein an outer periphery of said disks is provided with elastomeric sealing elements for resting against an inner side of said well casing.

8. A well regeneration apparatus according to claim 6, wherein an upwardly disposed one of said disks is provided with an opening for a suction connection of said feed pump.

9. A well regeneration apparatus according to claim 6, wherein a centrally disposed one of said disks permits passage of fluid to said upper pump chamber.

10. A well regeneration apparatus according to claim 9, wherein said components of said scrubber pump that convey fluid outwardly are pump rotors that are disposed in said pump chamber and via which fluid can be conveyed outwardly into said gravel bed, wherein a perforated pipe is provided that surrounds parts of said scrubber pump, and wherein a suction connection of said scrubber pump is disposed in said lower chamber within said perforated pipe, said suction connection conveying drawn-in fluid into said upper pump chamber.

11. A well regeneration apparatus according to claim 1, wherein said feed pump is disposed in a casing, an upper portion of which is mounted so as to be centered and is also provided with a cover means through which extends only a pressure connection of said feed pump, with a bottom portion of said casing being provided with inlet means for fluid from the region of said scrubber pump to a suction connection of said feed pump.

12. A method of regeneration apparatus according to claim 1, wherein said pump chamber of said scrubber pump is delimited by transversely extending disks.

13. A method of regenerating and maintaining a water well, especially utilizing an apparatus according to claim 1, including the step of:

mechanically cleaning an inner surface of a well casing; and during or after said mechanically cleaning step drawing water out of said well.

14. A method of regenerating and maintaining a water well, especially utilizing an apparatus according to claim 1, including the step of:

mechanically cleaning an inner surface of a well casing; during said mechanically cleaning step, drawing water out of a gravel bed from the casing region of said mechanical cleaning;

and returning said drawn-off water at least partially to a different location of said gravel bed.

15. A method according to claim 14, which includes the further step of drawing off water from the region of said mechanical cleaning via a riser.

16. A method according to claim 15, which includes repeating the sequence of said steps, whereby each step is carried out for approximately 4–8 minutes.

* * * * *